US007757780B2

(12) United States Patent
Pollock et al.

(10) Patent No.: US 7,757,780 B2
(45) Date of Patent: Jul. 20, 2010

(54) EXCAVATING METHOD AND APPARATUS

(75) Inventors: Edward Marshall Pollock, Toronto (CA); Jeffrey Haas, Toronto (CA); Patrick William Harbinson, Toronto (CA)

(73) Assignee: Utilicor Technologies Inc., Toronto (CA)

( * ) Notice: Subject to any disclaimer, the term of this patent is extended or adjusted under 35 U.S.C. 154(b) by 55 days.

(21) Appl. No.: 12/117,351

(22) Filed: May 8, 2008

(65) Prior Publication Data

US 2008/0277131 A1 Nov. 13, 2008

Related U.S. Application Data

(60) Provisional application No. 60/916,728, filed on May 8, 2007.

(51) Int. Cl.
*E21B 7/02* (2006.01)

(52) U.S. Cl. ..... 173/185; 173/42; 173/44; 172/25; 212/299

(58) Field of Classification Search ..... 173/28, 173/42, 39, 44, 185, 184, 213, 190, 192; 212/299; 299/39.1; 172/25, 26
See application file for complete search history.

(56) References Cited

U.S. PATENT DOCUMENTS

| | | | | |
|---|---|---|---|---|
| 2,856,155 | A | 10/1958 | Putt | |
| 3,089,550 | A * | 5/1963 | Watson | 173/147 |
| 3,525,404 | A | 8/1970 | Newman et al. | |
| 3,527,309 | A | 9/1970 | Rassieur | |
| 3,548,604 | A * | 12/1970 | Campbell | 405/303 |
| 3,754,604 | A | 8/1973 | Inaba et al. | |
| 3,768,578 | A * | 10/1973 | Russell, Jr. | 173/150 |
| 4,610,314 | A | 9/1986 | Gien | |
| 4,645,084 | A * | 2/1987 | Deike | 212/271 |
| 4,809,788 | A | 3/1989 | Nelson | |
| 5,226,488 | A | 7/1993 | Lessard et al. | |
| 5,377,767 | A * | 1/1995 | Briggs | 173/28 |
| 5,421,669 | A * | 6/1995 | Bertrand | 404/90 |
| 5,558,169 | A | 9/1996 | Madgwick et al. | |
| 5,662,176 | A * | 9/1997 | Madgwick et al. | 173/185 |
| 6,298,928 | B1 | 10/2001 | Penchansky | |
| 6,533,048 | B2 * | 3/2003 | Groce et al. | 175/316 |
| 6,896,072 | B2 * | 5/2005 | MacDonald | 173/192 |
| 6,907,874 | B1 * | 6/2005 | Faircloth | 125/13.01 |

(Continued)

FOREIGN PATENT DOCUMENTS

| | | |
|---|---|---|
| WO | 8504918 | 11/1985 |

*Primary Examiner*—Thanh K Truong
(74) *Attorney, Agent, or Firm*—Bereskin & Parr LLP/S.E.N.C.R.L.,s.r.l.

(57) ABSTRACT

An excavation apparatus includes a support structure mountable to a truck bed, the support structure defining a longitudinal direction extending front-to-back of the truck bed, and a lateral direction extending side-to-side of the truck bed. The apparatus further includes a rotary spindle pivotably supported by the support structure at a first pivot joint defining a generally horizontal first pivot axis, the spindle extending lengthwise along a spindle axis and rotatable thereabout for driving a cutting head; the spindle pivotable about the horizontal first pivot axis between a stowed position wherein the spindle axis is generally horizontal, and a deployed position wherein the spindle axis is generally vertical. The support structure includes a first adjustment device for adjusting the position of the spindle in the longitudinal direction when deployed, and a second adjustment device for adjusting the position of the spindle in the lateral direction when deployed.

20 Claims, 9 Drawing Sheets

U.S. PATENT DOCUMENTS 7,055,630 B1 * 6/2006 Burton ..... 175/203
7,128,165 B2 10/2006 McGivery
7,134,562 B2 * 11/2006 Burkett ..... 212/180
2003/0007835 A1 1/2003 Jurshak
2004/0112613 A1 * 6/2004 McGivery ..... 172/25

* cited by examiner

EXCAVATING METHOD AND APPARATUS

This application claims the benefit of Provisional Application No. 60/916,728, filed May 8, 2007, which is herein incorporated by reference.

FIELD

The teaching disclosed herein relates to one or methods and/or apparatuses for excavating, particularly localized excavating in which holes are provided in the ground and/or finished surfaces on the ground.

BACKGROUND

U.S. Pat. No. 5,451,128 (Hattersley) discloses a cutter blade having a cutting face. Formed in the cutting face are a plurality of spaced apart slots, each slot having forward and rearward sidewalls. A tooth is removably received in each of the slots, each tooth having a top surface extending above the cutting face and having forward and rearward sidewalls. The top surface of each tooth has a forward cutting edge and a rearward reduced height step section. A retention bar is provided for each tooth, each retention bar having a forward end that is received in the step section. A pin extending through an opening in each retention bar is threadably connected to the cutting face. By tightening the threaded pin the retention bar retains each tooth during cutting operation so that the tooth sidewalls frictionally engage the slot sidewalls and by unthreading the pin the retention bar may be rotated to permit removal and replacement of each of the teeth.

U.S. Pat. No. 7,128,165 (McGivery) discloses a system and method of cutting a core out of a finished surface for keyhole excavation, using a truck with a turret to which a support arm supporting the cutter assembly is mounted, and a stabilizing member remote from the turret, which allows the turret to be rotated about its complete arc of motion while stabilizing the support arm at any desired position about the truck. In a first embodiment the invention comprises an upstanding support rim affixed to or integrated into the bed of the truck. In a further embodiment the invention comprises a support member affixed to the horizontal arm and supported by the truck bed. This is disclosed as making the keyhole excavation procedure safer and more precise, and allowing a larger-depth cutting head to be used in order to penetrate thicker finished surfaces. In the preferred embodiment the cutter head is provided with a pilot which creates a pilot hole in the core that may facilitate removal, manipulation and replacement of the core, and may improve the integrity of the reinstated core.

SUMMARY

The following summary is intended to introduce the reader to this specification but not to define any invention. In general, this specification discusses one or more methods or apparatuses related to an excavation apparatus. In one example, the excavation apparatus comprises a support structure mountable to a truck bed extending along a longitudinal direction extending front-to-back of the truck bed, and a lateral direction extending side-to-side of the truck bed; and further comprising a rotary spindle pivotably supported by the support structure at a first pivot joint defining a generally horizontal first pivot axis. The spindle extends lengthwise along a spindle axis and is rotatable thereabout for driving a cutting head, and pivotable about the horizontal first pivot axis between a stowed position wherein the spindle axis is generally horizontal, and a deployed position wherein the spindle axis is generally vertical. The support structure comprises a first adjustment device coupling the spindle to the support structure for adjusting the position of the spindle in the longitudinal direction when deployed, and a second adjustment device coupling the spindle to the support structure for adjusting the position of the spindle in the lateral direction when deployed.

In some examples, the first adjustment device can comprise a horizontal slide mountable to the truck bed and the second adjustment device can comprise a second pivot joint defining a second pivot axis generally parallel to the spindle axis, the spindle pivotable relative to the truck bed about the second pivot axis. The support structure can further include a carriage coupled to the slide and a pivot arm pivotably connected to the carriage at the first pivot joint, the spindle supported by the pivot arm. A deployment actuator can be coupled to the pivot arm for pivoting the spindle between the deployed and stowed positions.

In some examples, the support structure can include a subframe, the spindle coupled to the subrame, and the subframe pivotably connected to the pivot arm at the second pivot joint. The subframe can comprise a track extending parallel to the spindle axis. A spindle carrier can be slidably coupled to the track, the spindle rotatably supported by the spindle carrier. A spindle motor can be fixed to the spindle carrier for driving the spindle and a press actuator can be coupled to the spindle carrier and the subframe for moving the spindle carrier along the track.

In some examples, the subframe can comprise a swivel positioning device for pivoting the subframe about the second pivot joint to a desired angular position relative to the pivot arm.

In some examples, the excavation apparatus can include a plurality of stabiliziers configured to bear against the ground adjacent the cutting head during penetration of the ground thereby. The plurality of stabiliziers can comprise a plurality of ground-engaging feet extending from a lower end of the subframe, and three ground-engaging feet arranged in a triangular configuration about the perimeter of the cutting head. Each one of the stabiliziers can further include an extendible member extending between the subframe and a respective one of the ground-engaging feet. The extendible member can include a hydraulic cylinder. The lower end of the subframe can comprise a stabilizier mounting member to which the ground engaging feet are attached.

In some examples, the excavation apparatus can include a horizontal slide mountable to a truck bed; a carriage coupled to the slide and movable between a retracted position when stowed and a variety of advanced positions for adjusting the front-to-back position of the spindle when deployed; and a rotary spindle coupled to the carriage, the spindle extending lengthwise along a spindle axis and rotatable thereabout for driving a cutting head. The spindle can be pivotable about a first generally horizontal pivot axis for pivoting the spindle between a generally horizontal position when stowed and a generally vertical position when deployed. The spindle can also be pivotable about a second pivot axis parallel to the spindle for adjusting the lateral position of the spindle when deployed.

In some examples, an excavation apparatus is provided with a rotary spindle for supporting a cutting head, the spindle extending lengthwise along a spindle axis; a subframe including a press actuator movable for advancing and retracting the spindle parallel to the spindle axis; and a pivot arm having a first pivot joint and a second pivot joint spaced apart from the first pivot joint, the first pivot joint defining a horizontal pivot axis, the second pivot joint defining a second pivot axis parallel to the spindle axis. The subframe can be pivotably connected to the pivot arm at the second pivot joint. The apparatus can further include a horizontal slide mountable to a truck bed, the slide including a carriage movable along the slide, and the pivot arm pivotably connected to the carriage at the first pivot joint.

Other aspects and features of the present specification will become apparent, to those ordinarily skilled in the art, upon review of the following description of the specific examples of the specification.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
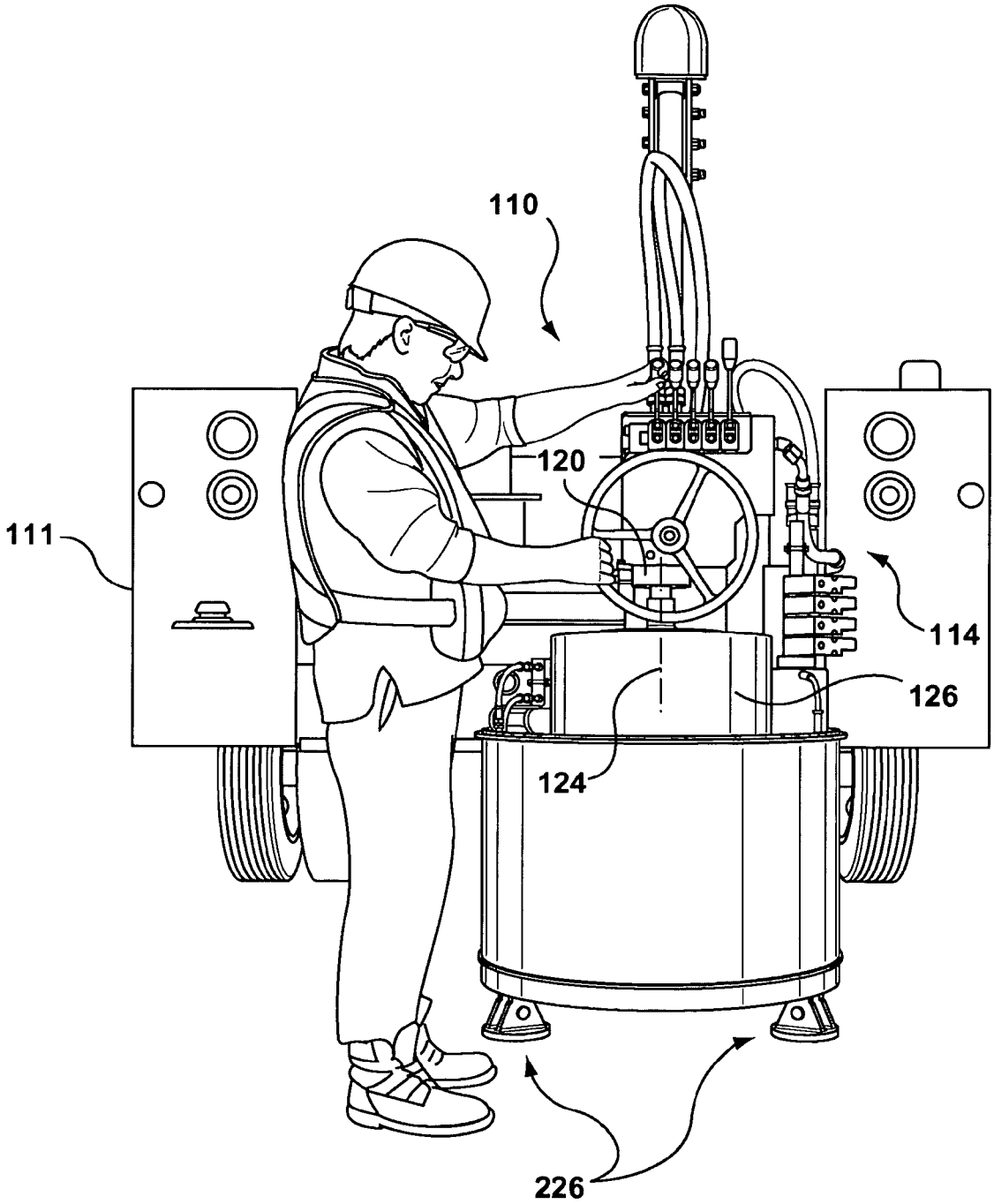
FIG. 1 is a front view of an example of an excavation apparatus, shown in a deployed position.
Figure 2:
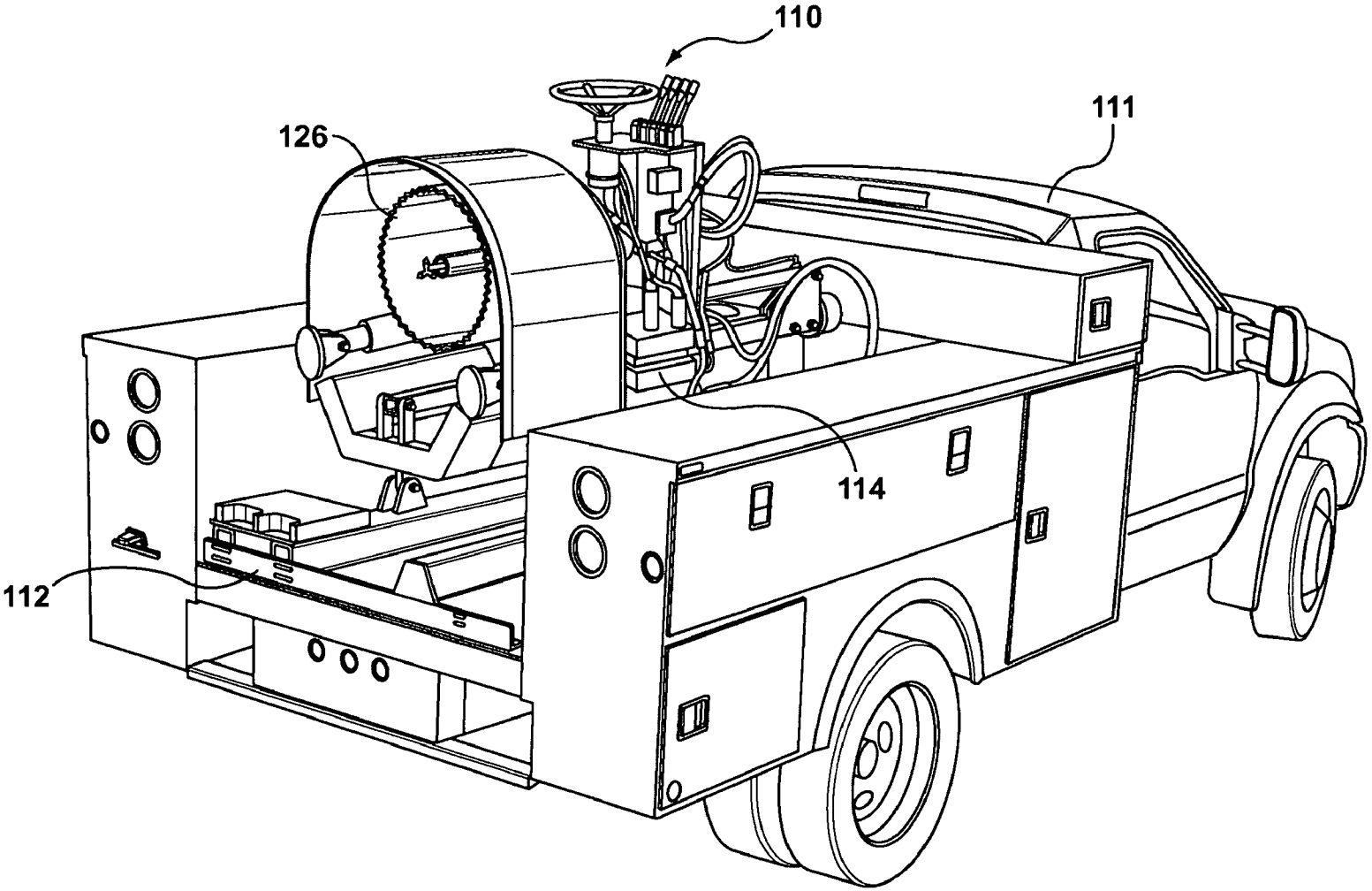
FIG. 2 is a perspective view of the apparatus of FIG. 1, shown in a stowed position.
Figure 3:
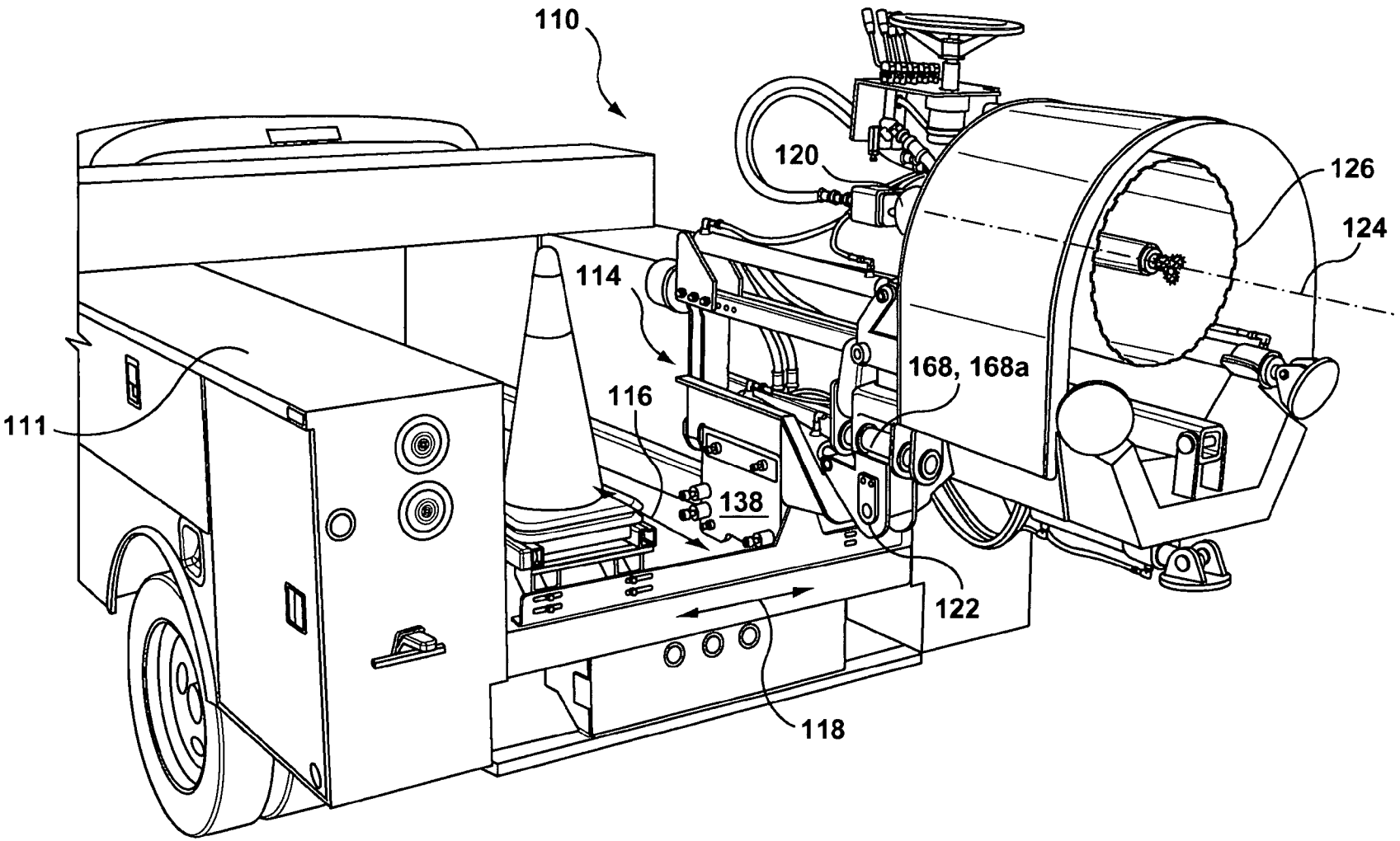
FIG. 3 is a perspective view of the apparatus of FIG. 1, shown in a partially stowed position.

Referring to FIGS. 1, 2 and 3, an excavation apparatus 110 is shown mounted to the bed 112 of a truck 111. The excavation apparatus 110 comprises a support structure 114 mounted to the truck bed 112. The support structure 114 has a longitudinal direction 116 extending front-to-back of the truck bed 112, and a lateral direction 118 extending side-to-side of the truck bed 112.

The excavation apparatus 110 further comprises a rotary spindle 120 pivotably connected to the support structure 114 at a first pivot joint 122. The spindle 120 extends lengthwise along a spindle axis 124 and is rotatable about the spindle axis 124 for driving a cutting head 126. The first pivot joint 122 defines a generally horizontal pivot axis 128 about which the spindle 120 can be pivoted between a stowed position (FIG. 2), wherein the spindle axis 124 is generally horizontal, and a deployed position wherein the spindle axis 124 is generally vertical (FIG. 1).

Figure 4:
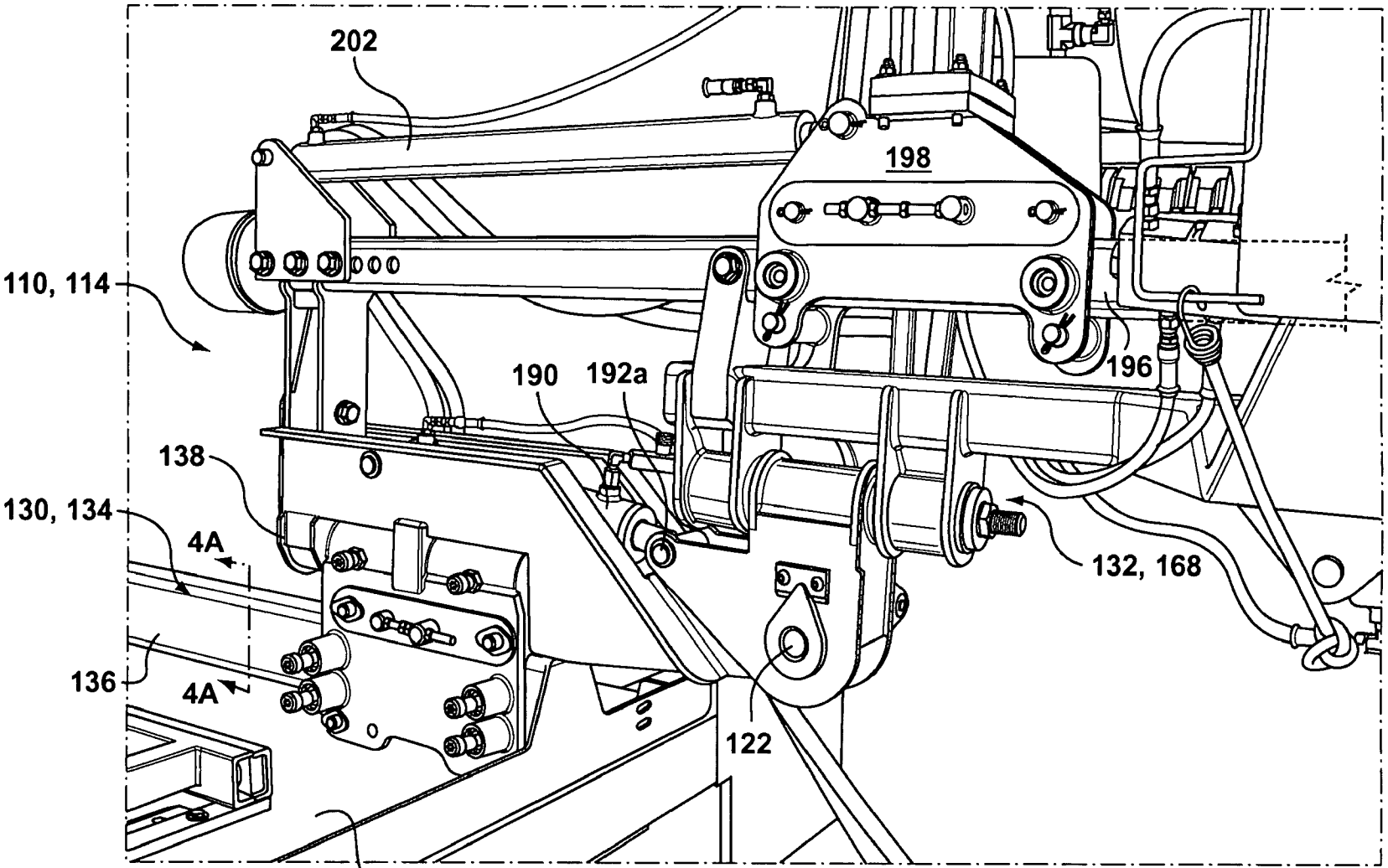
FIG. 4 is an enlarged view of a portion of the apparatus of FIG. 3.

Referring now also to FIG. 4, the support structure 114 comprises a first adjustment device 130 for adjusting the position of the spindle 120 in the longitudinal direction 116 when deployed, and a second adjustment device 132 for adjusting the position of the spindle 120 in the lateral direction 118 when deployed.

Figure 4A:
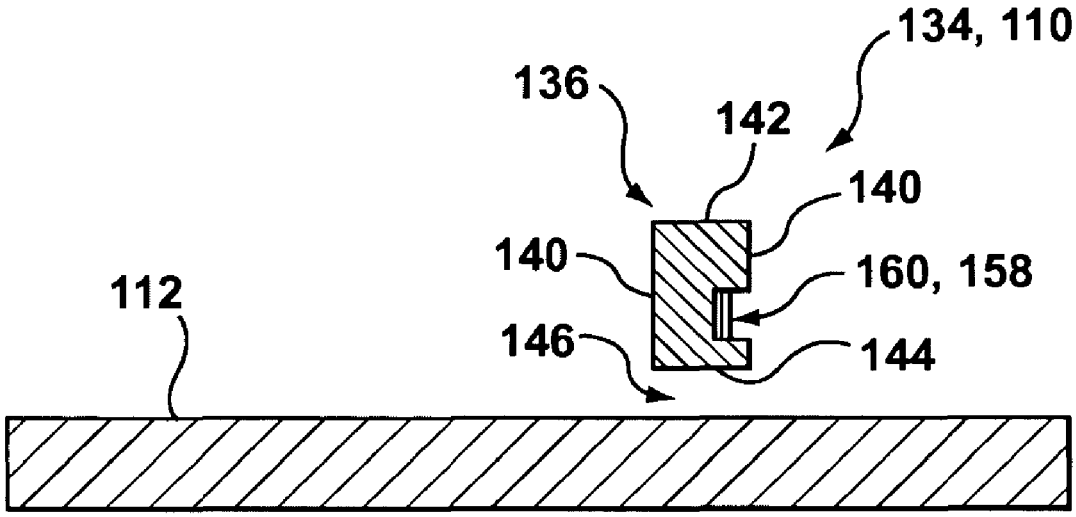
FIG. 4A is a section view of the apparatus of FIG. 4 taken along the line 4A-4A.
Figure 7:
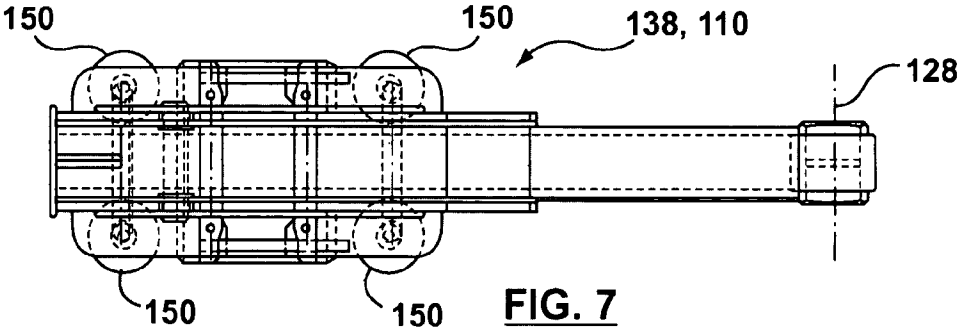
FIGS. 5, 6, and 7 are side, end, and top views, respectively, of a carriage member of the apparatus of FIG. 1.
Figure 5:
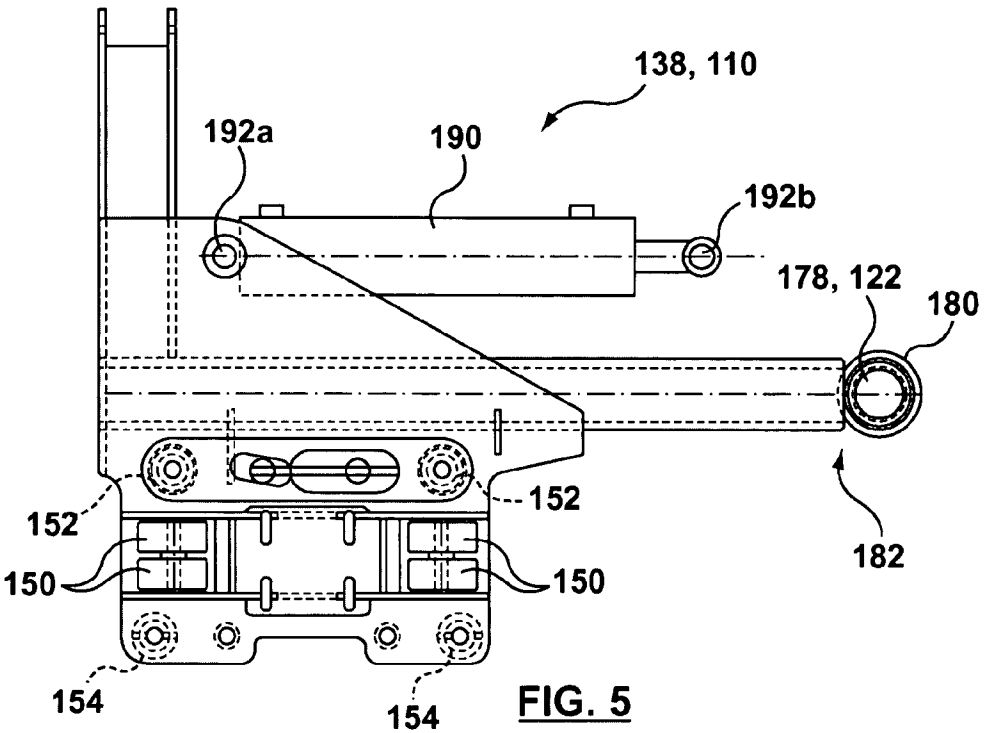
Figure 6:
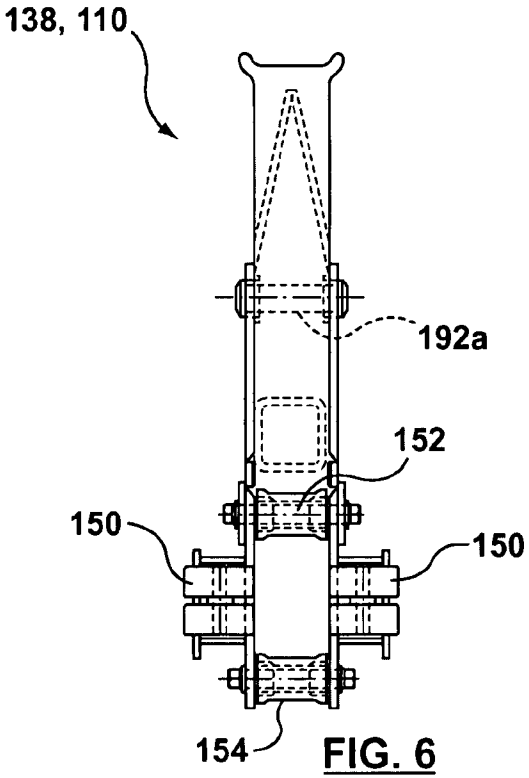

In the example illustrated, the first adjustment device 130 comprises a horizontal slide 134 mounted to the truck bed 112. The slide 134 comprises, in the example illustrated, a structural rail 136 extending parallel to the longitudinal direction 116. The support structure 114 comprises a carriage 138 that, in the example illustrated, is coupled to the rail 136. The rail 136 can be generally rectangular in cross section (FIG. 4A), having opposed vertical side surfaces 140 and generally horizontal top and bottom surfaces 142, 144 extending between the side surfaces. The bottom surface 144 is, in the example illustrated, mounted above the truck bed 112 so that a gap 146 is provided between the bottom surface 144 of the rail 136 and an upper surface 148 of the truck bed 112. As seen in FIGS. 5, 6, and 7, the carriage 138 can be provided with side rollers 150, upper rollers 152, and lower rollers 154 that bear against the side 140, top 142, and bottom 144 surfaces of the rail 136. The lower rollers 154 are accommodated by the gap 146, in the example illustrated. The rollers 150, 152, 154 can facilitate displacement of the carriage 138 along the rail 136 and retention of the carriage 138 in coupled engagement with the rail 136.

The slide 134 can comprise a propulsion mechanism 158 for propelling the carriage 138 to a desired position along the rail 136. In the example illustrated, the rail 136 comprises a rack 160 (FIG. 4A), and the carriage 138 comprises a pinion (not shown) engaged with the rack 160 and driven by a hydraulic motor. Rotation of the pinion in opposite directions causes a corresponding displacement of the carriage 138 in opposite directions along the rail 136.

Figure 8:
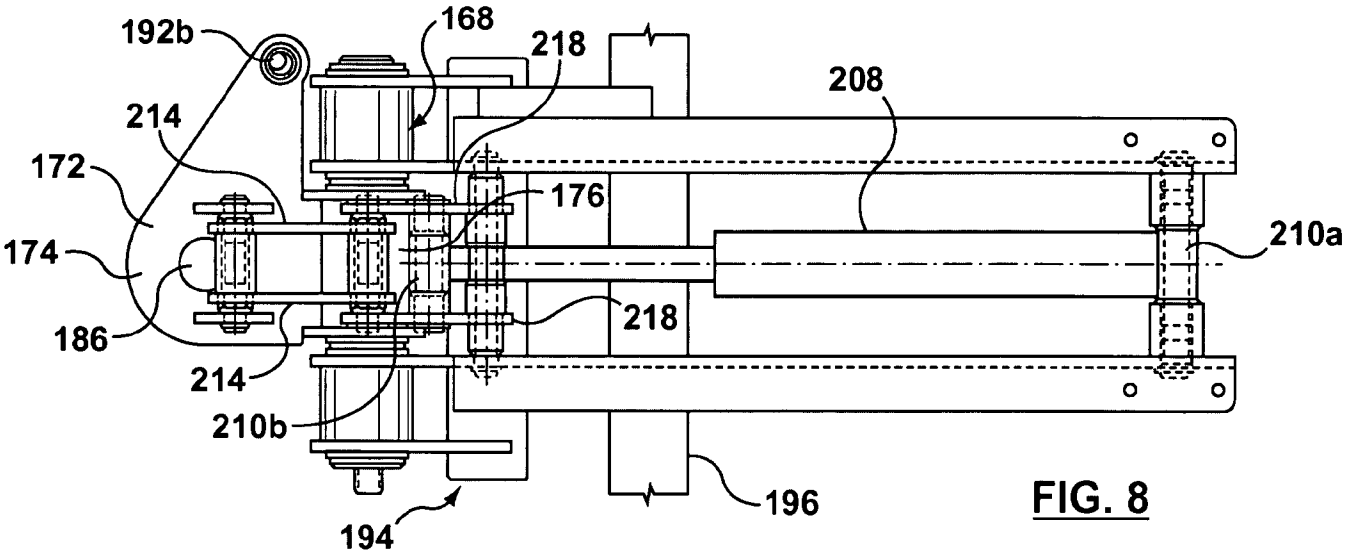
FIGS. 8 and 9 are elevation and plan views, respectively, of a portion of a support structure of the apparatus of FIG. 1.
Figure 9:
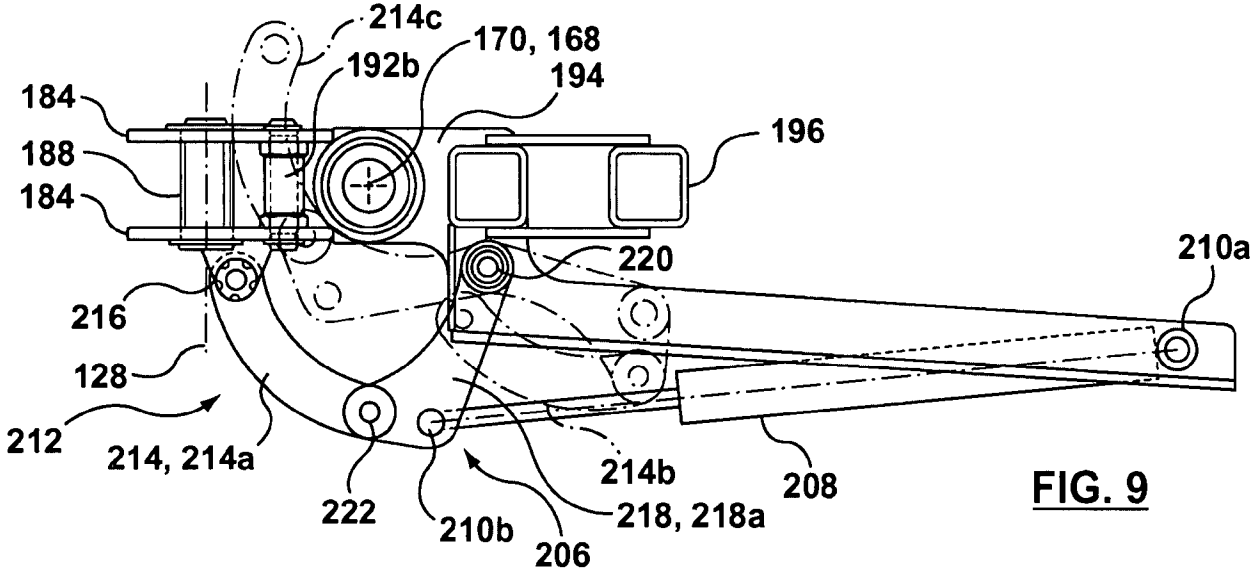

Referring to FIGS. 4, 8, and 9, in the example illustrated, the second adjustment device 132 comprises a second pivot 168 joint defining a second pivot axis 170 about which the spindle 120 can be pivoted. The second pivot axis 170 is generally parallel to the spindle axis 124, and accordingly, is oriented generally vertically when the spindle 120 is in the deployed position. The spindle 120 is radially offset from the second pivot axis 170 (horizontally offset from the second pivot axis 170 when in the deployed position).

Figure 10:
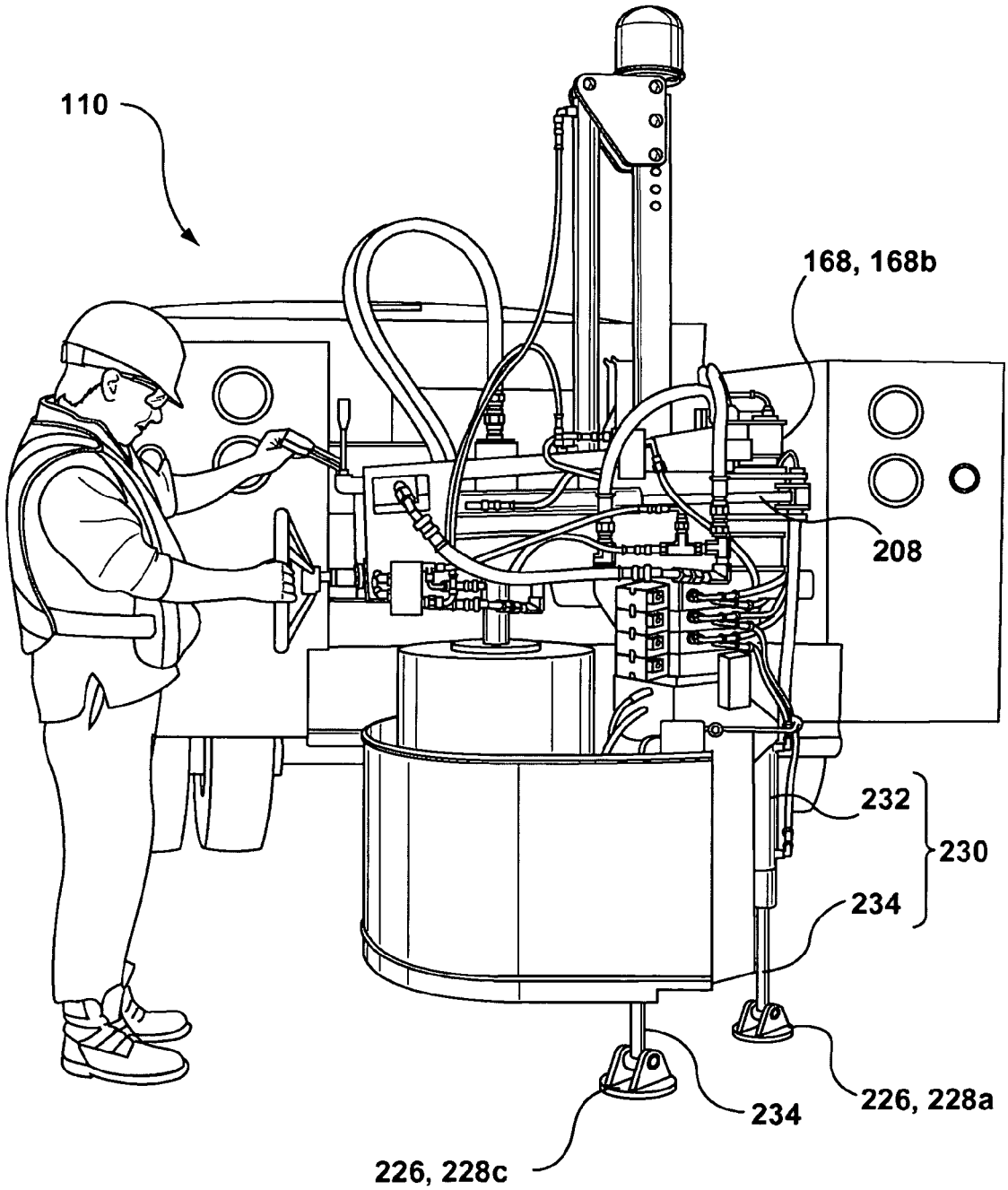
FIGS. 10 and 11 are front views of the excavation apparatus of FIG. 1, showing the spindle moved to the left and right positions, respectively.
Figure 11:
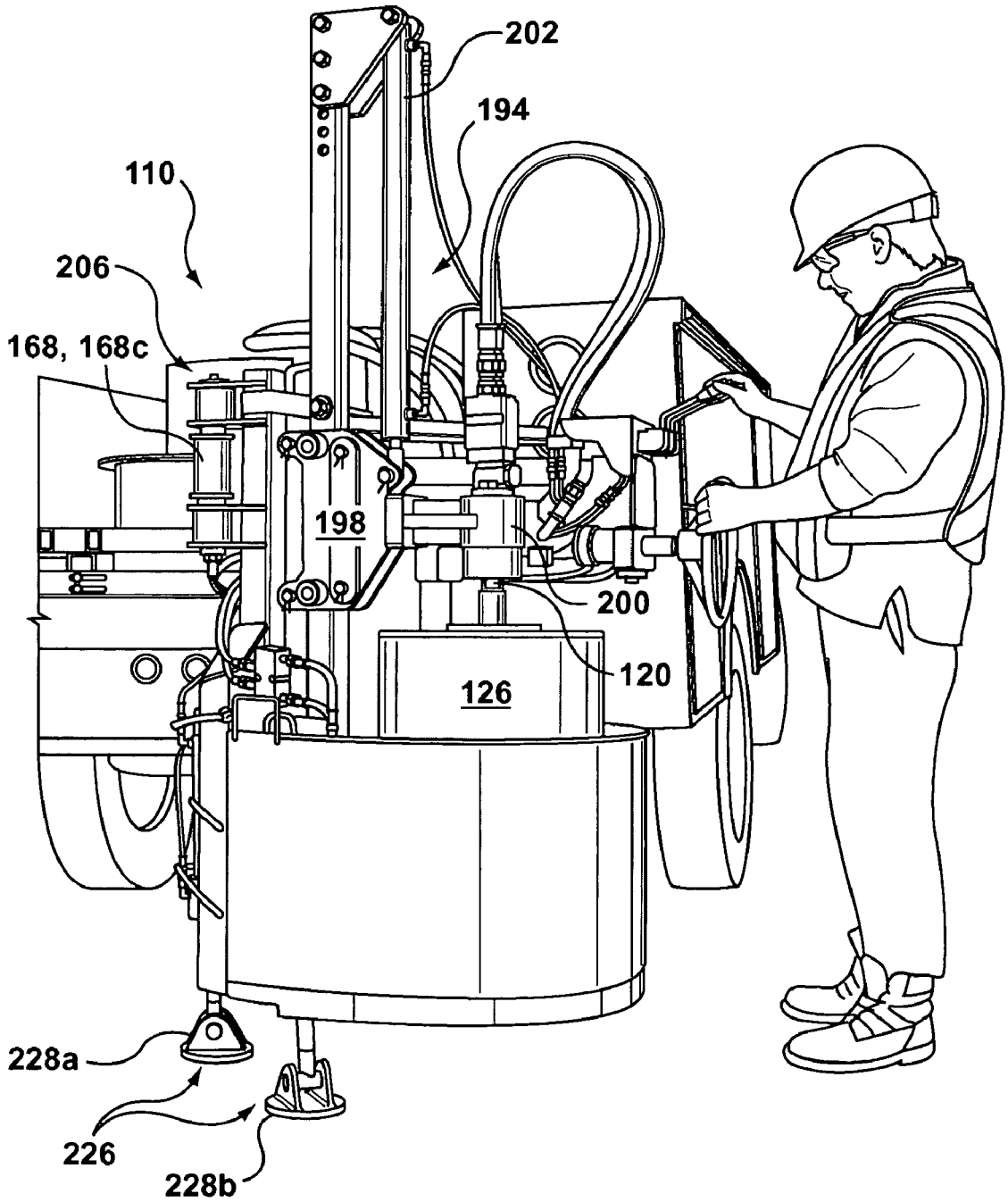

In the example illustrated, the second pivot joint 168 has a home position 168*a* in which, when the spindle 120 is in the deployed (vertical) position, the spindle axis 124 and the second pivot axis 170 are aligned in the longitudinal direction 116, with the spindle axis 124 positioned longitudinally rearward of the second pivot axis 170. Pivoting the spindle 120 about the second pivot axis 170 can thus adjust the position of the spindle 120 in the lateral direction 118 (i.e. along an arc extending longitudinally forward and laterally outward). In the example illustrated, the spindle 120 is pivotable about the second pivot axis 170 between a left position 168*b* (about 90 degrees clockwise from the home position when viewed from above) as seen in FIG. 10, and a right position 168*c* (about 90 degrees counterclockwise from the home position 168*a* when viewed from above), as seen in FIG. 11.

Further details of the excavation apparatus 110 and the first and second pivot joints 122, 168 are described with reference also to FIGS. 8 and 9. The support structure 114 of the illustrated example of the apparatus 110 further comprises a pivot arm 172 pivotably connected to the carriage 138 at the first pivot joint 122. The pivot arm 172 has a proximal end 174 and a distal end 176 spaced away from the proximal end 174. The first pivot joint 122 is proximate the proximal end 174 of the pivot arm 172. In the example illustrated, the first pivot joint 122 comprises a horizontal, laterally directed bore 178 provided in a boss 180 adjacent a leading (longitudinally rearward) end 182 of the carriage 138 (FIG. 5). The pivot arm 172 comprises a pair of spaced apart flanges 184 that straddle the boss 180, each flange 184 having an aperture 186 in registration with the bore 178 (FIG. 9). A pivot pin 188 extends through the bore 178 and the apertures 186, and can be held in position by snap rings or the like.

The support structure 114 can further include a pivot actuator 190 (FIG. 5) for moving the pivot arm 172 about the first (horizontal) pivot axis 128 to a desired angular position relative to the carriage 138. In the example illustrated, the pivot actuator 190 comprises a hydraulic cylinder having one end fixed to the carriage 138 at a first clevis 192*a*, and the other end fixed to the pivot arm 172 at a second clevis 192*b*, positioned radially offset from the horizontal pivot axis 128. Extending and retracting the pivot actuator 190 can move the spindle 120 between the deployed and stowed positions.

The support structure 114 can further comprise a subframe 194 (FIGS. 8 and 11) mounted between the pivot arm 172 and the spindle 120. In the example illustrated, the subframe 194 is pivotably connected to the pivot arm 172 at the second pivot joint 168, and the spindle 120 is coupled to the subframe 194. The subframe 194 can comprise a track 196 extending parallel to the spindle axis 124. In use, a cutter head 126 mounted to the spindle 120 can be raised and lowered relative to the ground by displacement of the spindle 120 relative to the track 196. For example, a spindle carrier 198 (FIG. 4) can be slidably coupled to the track 196, and the spindle 120 can be rotatably supported by the spindle carrier 198. In the example illustrated, the rotation of the spindle 120 is driven by a spindle motor 200 (FIG. 11) having a housing from which the spindle 120 can extend. The spindle motor 200 can be fixed to the spindle carrier 198.

The excavation apparatus 110 can further comprise a press actuator 202 coupled to the spindle carrier 198 and the subframe 194 for moving the spindle carrier 198 along the track 196. In the example illustrated, the press actuator 202 comprises a hydraulic cylinder having one end fixed to the subframe 194, and the other end fixed to the spindle carrier 198. Extending the press actuator 202 of the illustrated example urges the spindle 120 (and cutter head 126 attached thereto) towards (and into) the ground when the spindle 120 is in the deployed position.

The subframe 194 can comprise a swivel positioning device 206 for pivoting the subframe 194 about the second pivot joint 168 to a desired angular position relative to the pivot arm 172.

In the example illustrated, the swivel positioning device 206 comprises a swivel link assembly 212 (FIG. 9) for coupling the swivel actuator 208 to the pivot arm 172. The swivel link assembly 212 includes a first swivel link 214 pivotably coupled to the pivot arm at a first link pivot 216, and a second swivel link 218 pivotably coupled to the subframe 194 at a second link pivot 220. The first and second swivel links 214, 218 are pivotably coupled together at a third link pivot 222, spaced apart from the first and second link pivots 216, 218. Each of the link pivots are pivotable about respective axes parallel to the second pivot axis 170. Retracting the swivel actuator 208 can pivot the subframe 194 clockwise about the second pivot axis 170, to the left position 168*b*. Extending the swivel actuator 208 can move the subframe 194 (and second pivot joint) to the right position 168*c*. Each swivel link has a home position 214*a*, 218*a*, left position 214*b*, 218*b*, and a right position 214*c*, 218*c* generally corresponding to the home, left, and right positions 168*a*, 168*b*, 168*c*, respectively, of the second pivot joint 168.

In the example illustrated, the swivel positioning device 206 comprises a swivel actuator 208 in the form of an extendible hydraulic cylinder having one end fixed to the subframe 194 at a first swivel clevis 210*a*, and a second, opposite end coupled to the pivot arm 172 at a second swivel clevis 210*b*.

The excavation apparatus 110 can further comprise a plurality of stabiliziers 226 (FIGS. 10 and 11) configured to bear against the ground adjacent the cutting head 126 during penetration of the ground thereby. The plurality of stabiliziers 226 can comprise a plurality of ground-engaging feet 228 extending from a lower end of the subframe 194. In the example illustrated, three ground-engaging feet 228*a*, 228*b*, 228*c* are arranged in a triangular configuration about the perimeter of the cutting head 126. Each one of the stabiliziers 226 in the example illustrated comprises an extendible member 230 extending between the subframe 194 and a respective one of the ground-engaging feet 228. The extendible member 230 can be a hydraulic cylinder with a cylinder portion 232 secured to the subframe 194, and a piston rod 234 attached to a respective one of the feet 228.

In use, the truck 111 can be moved into an approximate position near a buried plant (such as a valve or joint) to which access is required. The apparatus 110 is moved to a deployed position by moving the carriage 198 rearwards, and pivoting the subframe 194 (and attached spindle 120) about the horizontal pivot axis 128 to the upright (vertical) position. The spindle 120 can be lowered toward the ground by using the press actuator 202.

Once near the ground, the position of the cutting head can be compared to the target position, in registration with the buried plant. The position of the cutting head 126 can be adjusted in the longitudinal and lateral directions 116, 118 (without repositioning the truck 111) by extending or retracting the slide 134, and by pivoting the subframe 194 about the second pivot axis 170 to the left or right. Once the cutter head 126 is accurately located above the target, the stabiliziers can be lowered to securely support the subframe 194 in position over the target. The spindle motor 200 can then be engaged, and the rotating cutter head 126 can be pressed into the ground. The cutter head 126 can cut a cylindrical hole, for example 18 inches in diameter, down to the buried plant. The cutter head 126 can penetrate a finished layer, for example asphalt or concrete, covering the ground, which can be removed as a disc or coupon and reinstated when filling the hole back in.

While the above description provides examples of one or more processes or apparatuses, it will be appreciated that other processes or apparatuses may be within the scope of the accompanying claims.

The invention claimed is:

1. An excavation apparatus, comprising:

a) a support structure mountable to a truck bed, the support structure defining a longitudinal direction extending front-to-back of the truck bed, and a lateral direction extending side-to-side of the truck bed; and b) a rotary spindle pivotably supported by the support structure at a first pivot joint defining a generally horizontal first pivot axis, the spindle extending lengthwise along a spindle axis and rotatable thereabout for driving a cutting head; the spindle pivotable about the horizontal first pivot axis between a stowed position wherein the spindle axis is generally horizontal, and a deployed position wherein the spindle axis is generally vertical;

and wherein the support structure comprises a first adjustment device coupling the spindle to the support structure for adjusting the position of the spindle in the longitudinal direction when deployed, and a second adjustment device coupling the spindle to the support structure for adjusting the position of the spindle in the lateral direction when deployed;

wherein the first adjustment device comprises a horizontal slide mountable to the truck bed;

wherein the second adjustment device comprises a second pivot joint defining a second pivot axis generally parallel to the spindle axis and spaced apart orthogonally therefrom, the spindle pivotable relative to the truck bed about the second pivot axis;

wherein the support structure comprises a carriage coupled to the slide; and wherein the second pivot axis is positioned longitudinally rearwardly of the carriage when the spindle is in the deployed position.

2. The apparatus of claim 1, wherein the support structure comprises a pivot arm pivotably connected to the carriage at the first pivot joint, the spindle supported by the pivot arm.

3. The apparatus of claim 2, comprising a deployment actuator coupled to the pivot arm for pivoting the spindle between the deployed and stowed positions.

4. The apparatus of claim 2, wherein the support structure comprises a subframe, the spindle coupled to the subframe and the subframe pivotably connected to the pivot arm at the second pivot joint.

5. The apparatus of claim 4, wherein the subframe comprises a track extending parallel to the spindle axis.

6. The apparatus of claim 5, wherein the subframe comprises a spindle carrier slidably coupled to the track, the spindle rotatably supported by the spindle carrier, and wherein the apparatus further comprises a spindle motor for driving the spindle, the spindle motor fixed to the spindle carrier, and a press actuator coupled to the spindle carrier and the subframe for moving the spindle carrier along the track.

7. The apparatus of claim 4, wherein the subframe further comprises a swivel positioning device for pivoting the subframe about the second pivot joint to a desired angular position relative to the pivot arm, wherein the swivel positioning device comprises a swivel actuator coupled to the subframe and the pivot arm.

8. The apparatus of claim 7, wherein the swivel positioning device comprises a first link pivotably connected to the pivot arm, a second link pivotably connected to the subframe, the first and second links pivotably connected together.

9. The apparatus of claim 8, wherein the swivel actuator comprises an extendible cylinder having one end pivotably coupled to at least one of the first and second links.

10. The excavation apparatus of claim 1, wherein when in the stowed position, the support structure and rotary spindle are within a periphery of the truck bed.

11. The excavation apparatus of claim 1, wherein the cutting head comprises a cylindrical blade having teeth on an outer perimeter thereof.

12. The excavation apparatus of claim 11, wherein the cylindrical blade has an outer diameter of about 18 inches.

13. The excavation apparatus of claim 1, wherein the generally horizontal first pivot axis is the only horizontal axis about which the rotary spindle is pivotable.

14. An excavation apparatus, comprising:

a) a horizontal slide mountable to a truck bed;

b) a carriage coupled to the slide and a rotary spindle coupled to the carriage, the carriage movable between a retracted position when stowed and a variety of advanced positions for adjusting the front-to-back position of the spindle when deployed in a generally vertical position;

c) a cutting head supported by the rotary spindle, the spindle extending lengthwise along a spindle axis and rotatable thereabout for driving the cutting head, the cutting head comprising a cylindrical blade having teeth on an outer perimeter thereof; the spindle pivotable about a first generally horizontal pivot axis for pivoting the spindle between a generally horizontal position when stowed and said generally vertical position when deployed; and d) the spindle pivotable about a second pivot axis parallel to the spindle for adjusting the lateral position of the spindle when deployed.

15. The apparatus of claim 14, wherein the horizontal slide extends front-to-back in a longitudinal direction, and the second pivot axis is positioned longitudinally rearward of the carriage when the spindle is in the generally vertical deployed position.

16. An excavation apparatus, comprising:

a) a rotary spindle for supporting a cutting head; the spindle extending lengthwise along a spindle axis;

b) a spindle carrier including a motor mounted thereto for rotating the spindle, the spindle mounted to the spindle carrier;

c) a subframe including a press actuator movable for advancing and retracting the spindle parallel to the spindle axis, the spindle carrier slidably coupled to the subframe;

d) a rigid pivot arm having a first pivot joint and a second pivot joint spaced apart from the first pivot joint, the first pivot joint defining a generally horizontal first pivot axis, the second pivot joint pivotably connecting together the pivot arm and the subframe, the second pivot joint defining a second pivot axis oriented parallel to the spindle axis, the second pivot joint provided between the first pivot joint and the spindle, the spindle pivotable about the first pivot joint for pivoting the spindle between a generally horizontal position when stowed and a generally vertical position when deployed; and e) a horizontal slide mountable to a truck bed, the slide including a carriage movable along the slide, the pivot arm pivotably connected to the carriage at the first pivot joint.

17. The apparatus of claim 16, wherein the horizontal slide extends front-to-back in a longitudinal direction, and the second pivot axis is positioned longitudinally rearward of the carriage when the spindle is in the generally vertical deployed position.

18. The apparatus of claim 16, wherein the first pivot axis is positioned at an elevation below the second pivot axis when the spindle is in the generally horizontal stowed position.

19. The apparatus of claim 16, wherein the second pivot joint is provided vertically between the first pivot joint and the spindle when the spindle is in the generally horizontal stowed position.

20. The apparatus of claim 16, wherein the second pivot axis is parallel to the spindle axis when the spindle is in, and pivoting between, the stowed and deployed positions.

* * * * *